US007040372B2

(12) United States Patent
Johansson et al.

(10) Patent No.: US 7,040,372 B2
(45) Date of Patent: May 9, 2006

(54) INFORMATION PRESENTATION DEVICE

(75) Inventors: Gert Johansson, Lerum (SE); Hans Hellström, Onsala (SE)

(73) Assignee: Mark Bric Intressenter AB, Lerum (SE)

( * ) Notice: Subject to any disclaimer, the term of this patent is extended or adjusted under 35 U.S.C. 154(b) by 0 days.

(21) Appl. No.: 10/396,076

(22) Filed: Mar. 25, 2003

(65) Prior Publication Data

US 2004/0020603 A1 Feb. 5, 2004

Related U.S. Application Data

(63) Continuation of application No. PCT/SE00/01852, filed on Sep. 25, 2000.

(51) Int. Cl.
*A47H 1/00* (2006.01)

(52) U.S. Cl. ..... 160/24; 160/301; 160/315

(58) Field of Classification Search ..... 160/24, 160/315, 23.1, 301, 302, 323.1, 191, 192, 160/383, 395, 392, 403, 405
See application file for complete search history.

(56) References Cited

U.S. PATENT DOCUMENTS 1,562,105 A * 11/1925 McDonald ..... 160/392
1,810,849 A * 6/1931 Nye ..... 160/315
1,937,209 A * 11/1933 Traut ..... 160/23.1
1,947,070 A * 2/1934 Traut ..... 160/23.1
2,589,608 A 3/1952 Foster
2,589,609 A * 3/1952 Foster ..... 160/23.1
2,696,249 A * 12/1954 Prokop et al. ..... 160/24
2,812,809 A * 11/1957 Nicholas ..... 160/24
2,822,040 A * 2/1958 Petrick et al. ..... 160/24
3,018,824 A 1/1962 Anderson et al.
3,228,455 A 1/1966 Jacobson et al.
3,263,735 A * 8/1966 Vecchiarelli et al. ..... 160/242
3,724,524 A 4/1973 Potter
4,794,715 A 1/1989 Cherwin
5,778,490 A * 7/1998 Curtis ..... 16/198
5,798,861 A 8/1998 Doat
6,046,845 A 4/2000 Niwa et al.

FOREIGN PATENT DOCUMENTS

DE 3231091 A1 5/1983
WO WO00/47508 8/2000

* cited by examiner

*Primary Examiner*—David Purol
(74) *Attorney, Agent, or Firm*—Gauthier & Connors LLP

(57) ABSTRACT

An information presentation device and methods for mounting a display sheet to the device. The device includes an elongate housing having a first opening through which the display sheet passes. The display sheet is wound onto a drum within the housing. A releasable attachment arrangement in the form of an attachment strip to which a display sheet can be affixed and a receiving slot in the drum permits a display sheet to be attached to and removed from the information presentation device without the need to disassemble the device.

13 Claims, 4 Drawing Sheets

INFORMATION PRESENTATION DEVICE

This application is a continuation of International Application No. PCT/SE00/01852, filed on Sep. 25, 2000.

TECHNICAL FIELD

The present invention relates to an information presentation device according to the preamble of claim 1. The invention further relates to methods of mounting a display sheet to an information presentation device.

BACKGROUND OF THE INVENTION

Various portable information presentation devices are known which include a display sheet wound onto a drum, the drum being journalled for rotation in an elongate housing. The housing is provided with a slot through which the display sheet passes. The display sheet can be unwound from the drum against the action of a biasing spring and maintained in an upright position to thereby display information printed on one side of the display sheet. One such information presentation device is disclosed in U.S. Pat. No. 5,798,861.

A disadvantage with previously known devices is that, should it be desirable to change the information which is to be displayed, the device has to be disassembled, the original display sheet must be detached from the drum and a new sheet attached in its place. Often, the display sheet is adhered to the drum, thereby rendering the task of exchanging the display sheet more difficult. Due to the perceived awkwardness of this operation, it is not uncommon for a user simply to order a complete new device with preprinted information.

SUMMARY OF THE INVENTION

It is therefore an object of the present invention to provide an information presentation device in which exchange of the information which is to be presented is facilitated.

This object is achieved in accordance with the present invention by an information presentation device comprising an elongate housing having two opposed end walls and a first opening extending longitudinally between said end walls;

a drum extending about a longitudinal axis and mounted for rotation in said housing between said end walls such that said longitudinal axis is substantially parallel to said first opening in said housing; and attachment means for attaching a display sheet to said drum such that said display sheet can be wound around said drum; the attachment means comprising:

an attachment strip for attachment to one end of said display sheet, and receiving means on said drum for releasably engaging said attachment strip; said attachment strip and said receiving means forming a releasable mechanical connection.

It is a further object of the present invention to provide a method of mounting a display sheet to an information presentation device, which method facilitates exchange of the display sheet.

This object is achieved in accordance with the present invention by a method of mounting a display sheet to an information presentation device, said device comprising:

an elongate housing having two opposed end walls and a first opening extending longitudinally between said end walls;

a spring-biased drum extending about a longitudinal axis and mounted for rotation in said housing between said end walls such that said longitudinal axis is substantially parallel to said first opening in said housing;

attachment means for attaching a display sheet to said drum such that said display sheet can be wound around said drum, said attachment means comprising:

an attachment strip attached to one end of said display sheet, and receiving means on said drum for releasably engaging said attachment strip; said method comprising the steps of:

bringing said receiving means on said drum into alignment with an insertion opening in one of said end walls of said housing;

inserting said attachment strip through said insertion opening in a direction substantially parallel to said longitudinal axis such that said attachment strip is brought into engagement with said receiving means on said drum;

winding said display sheet around said drum, and tensioning said spring-biased drum such that said drum tends to retain said display sheet in said housing.

The above object is also attained in accordance with the present invention by a method of mounting a display sheet to an information presentation device, said device comprising:

an elongate housing having two opposed end walls and a first opening extending longitudinally between said end walls;

a pretensioned spring-biased drum extending about a longitudinal axis and mounted for rotation in said housing between said end walls such that said longitudinal axis is substantially parallel to said first opening in said housing;

attachment means for attaching a display sheet to said drum such that said display sheet can be wound around said drum, said attachment means comprising:

an attachment strip attached to one end of said display sheet, and receiving means on said drum for releasably engaging said attachment strip; and locking means for locking said pretensioned spring-biased drum such that said receiving means on said drum is aligned with an insertion opening in an end wall of said housing; said method comprising the steps of:

inserting said attachment strip through said insertion opening in a direction substantially parallel to said longitudinal axis such that said attachment strip is brought into engagement with said receiving means on said drum; and releasing said locking means such that said display sheet is caused to be wound around said drum.

The above object is further achieved by a method of mounting a display sheet to an information presentation device, said device comprising:

an elongate housing having two opposed end walls and a first opening extending longitudinally between said end walls;

a spring-biased drum extending about a longitudinal axis and mounted for rotation in said housing between said end walls such that said longitudinal axis is substantially parallel to said first opening in said housing;

attachment means for attaching a display sheet to said drum such that said display sheet can be wound around said drum, said attachment means comprising:

an attachment strip attached to one end of said display sheet, and receiving means on said drum for releasably engaging said attachment strip;

said method comprising the steps of:

bringing said receiving means on said drum into alignment with said first opening in said elongate housing;

inserting said attachment strip through said elongate opening in a direction substantially perpendicular to said longitudinal axis such that said attachment strip is brought into engagement with said receiving means on said drum;

winding said display sheet around said drum, and tensioning said spring-biased drum such that said drum tends to retain said display sheet in said housing.

The above object is also attained in accordance with the present invention by a method of mounting a display sheet to an information presentation device, said device comprising:

an elongate housing having two opposed end walls and a first opening extending longitudinally between said end walls;

a pretensioned spring-biased drum extending about a longitudinal axis and mounted for rotation in said housing between said end walls such that said longitudinal axis is substantially parallel to said first opening in said housing;

attachment means for attaching a display sheet to said drum such that said display sheet can be wound around said drum, said attachment means comprising:

an attachment strip attached to one end of said display sheet, and receiving means on said drum for releasably engaging said attachment strip; and locking means for locking said pretensioned spring-biased drum such that said receiving means on said drum is aligned with said first opening in said housing; said method comprising the steps of:

inserting said attachment strip through said first opening in a direction substantially perpendicular to said longitudinal axis such that said attachment strip is brought into engagement with said receiving means on said drum; and releasing said locking means such that said display sheet is caused to be wound around said drum.

Since, in accordance with the present invention, the attachment strip to which a display sheet may be affixed can be inserted and removed from the information presentation device without the need to dismantle the device, one and the same information presentation device can effectively be used together with many different display sheets.

Preferred embodiments of the present invention are detailed in the dependent claims.

BRIEF DESCRIPTION OF THE DRAWINGS

The present invention will be described in the following by way of example only and with reference to the attached drawings, in which.

DETAILED DESCRIPTION OF PREFERRED EMBODIMENTS

Figure 1:
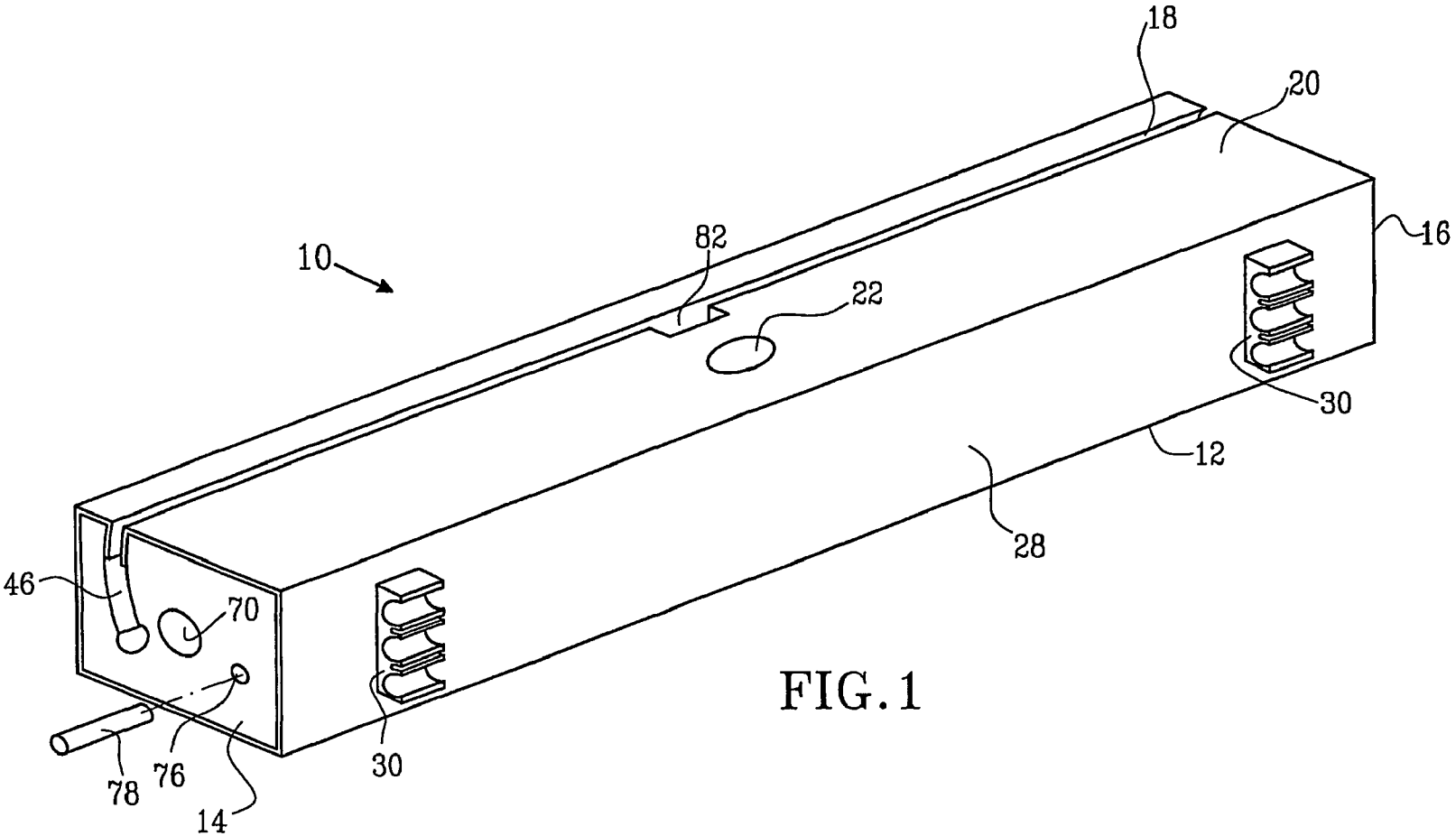
FIG. 1 is a schematic perspective view of a first embodiment of an information presentation device according to the present invention viewed from behind.

In the drawings, reference numeral 10 generally denotes an information presentation device according to the present invention. The device 10 comprises an elongate housing 12 having two opposed end walls 14,16 respectively. Preferably, the housing is rectangular and is fabricated from pressed sheet metal. A first opening 18 is provided in an upwardly facing wall 20 of the housing, the opening extending longitudinally between the two end walls 14,16. The upwardly facing wall 20 is advantageously provided with a second opening 22 positioned centrally between the end walls 14,16. As is most clearly shown in FIG. 2, the second opening 22 serves to accommodate an end of a preferably collapsable support rod 24. As will be apparent from the following description, the support rod 24 is adapted to support a display sheet 26 in an erect condition. A rear surface 28 of the housing may be equipped with support rod storage means 30, for example in the form of a pair of clips, so that the support rod 24, or at least its constituent components, can be stored and/or transported together with the housing when the information presentation device is not being used.

With particular reference to FIGS. 2, 4, 5 and 6, the information presentation device 10 further comprises a drum 32 having an outer surface 33, the drum extending about a longitudinal axis 34. The drum 32 is mounted for rotation in the housing 10 between the two end walls 14,16 such that the longitudinal axis 34 is substantially parallel to the first opening 18 in the housing. The drum 32 is intended to cooperate with the display sheet 26 such that the display sheet can be selectively wound onto and off the drum. To achieve this, the device according to the present invention further comprises attachment means, generally denoted 36 (see FIGS. 3 and 6), for releasably attaching the display sheet 26 to the drum.

In accordance with the present invention, the attachment means 36 comprises an attachment strip 38 for attachment, for example using adhesive, to one end of the display sheet, and receiving means 40 on the drum 32 for releasably engaging the attachment strip 38. In this manner, the attachment strip and receiving means form a releasable mechanical connection. Preferably, the attachment strip 38 and the receiving means 40 form a male/female joint in which the attachment strip comprises the male component of the joint. Thus, in one embodiment of the invention illustrated in FIGS. 1 to 4, the receiving means 40 may be a longitudinally extending slot 42 having a tangential opening with a restriction to thereby delimit a chamber in the base of the slot. The slot 42 preferably extends the entire length of the drum 32. The chamber in the base of the slot is adapted to accommodate a bulbous lower portion 44 of the attachment strip 38 so that the attachment strip is constrained to rotate with the drum. As will be described below, the construction of the attachment means 36 permits the attachment strip 38 to be inserted in the longitudinal direction into the receiving means 40.

Figure 5:
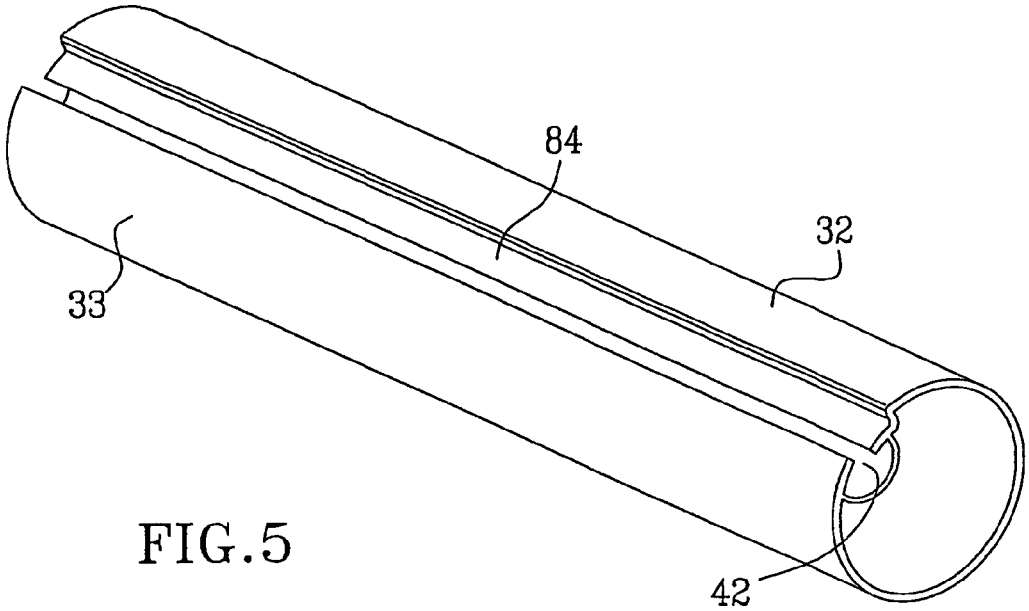
FIG. 5 is a schematic perspective view of a second embodiment of a drum for use in an information presentation device according to the present invention.
Figure 6:
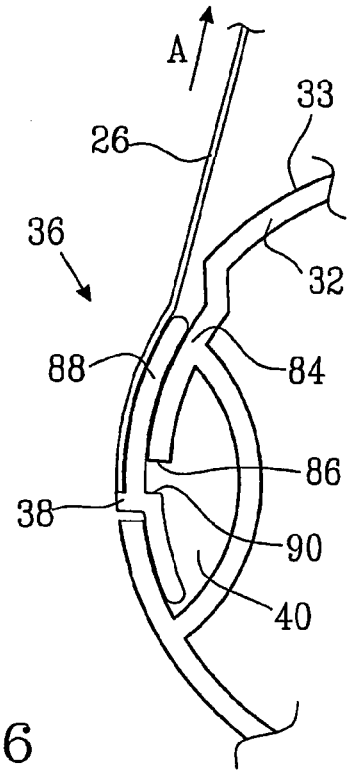
FIG. 6 is an end view on a larger scale of the drum illustrated in FIG. 5.

In a second embodiment of the invention illustrated in FIGS. 5 and 6, the receiving means 40 is again a longitudinally extending slot 42. In this embodiment, the outer surface 33 of the drum 32 is provided with a recessed arcuate portion 84 which at least partially delimits one edge 86 of the slot 42. The attachment strip 38 is also provided with an arcuate portion 88 which, when the attachment strip is engaged in the longitudinally extending slot, overlies the recessed arcuate portion 84 of the outer surface of the drum. To ensure that the attachment strip 38 and the drum 32 will co-rotate, the attachment strip 38 further comprises a longitudinally extending shoulder 90. As is most clearly shown in FIG. 6, the shoulder 90 is adapted to abut the one edge 86 of the longitudinally extending slot 42 when the display sheet 26 is erected, i.e. when a force is applied to the display sheet in the direction of the arrow A. As will be described later, the construction of the attachment means 36 permits the attachment strip 38 to be inserted in a direction perpendicular to the longitudinal axis of the drum 32 into the receiving means 40.

Figure 2:
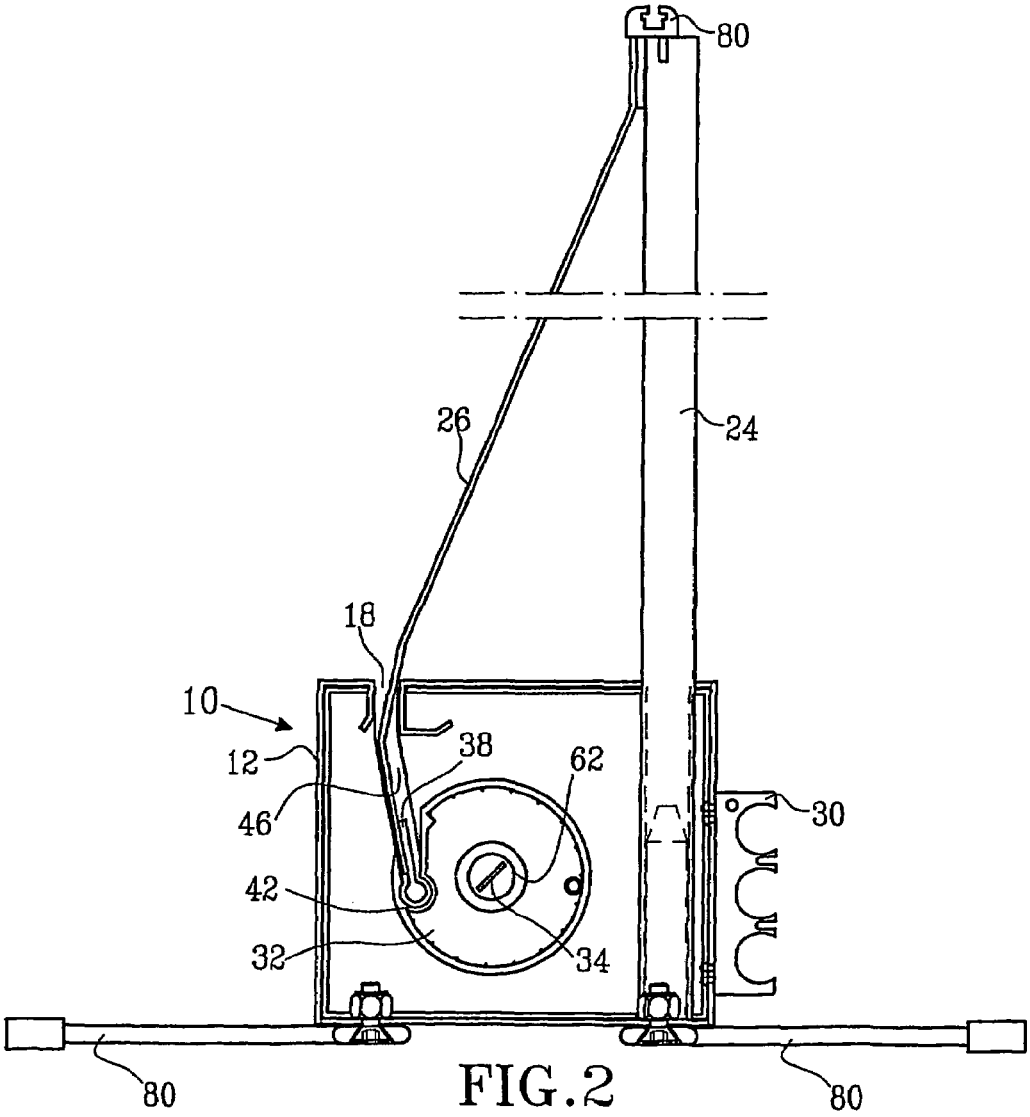
FIG. 2 is a schematic end view of the device according to FIG. 1 equipped with a display sheet.
Figure 3:
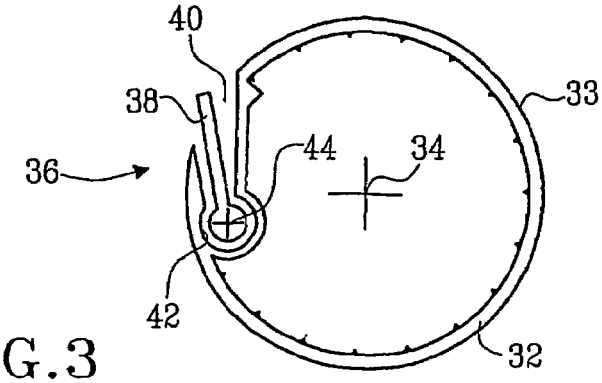
FIG. 3 is a schematic end view of a drum forming part of the device according to FIG. 1.

In terms of the first embodiment, and as is most clearly illustrated in FIGS. 1 and 2, at least one end wall 14 of the housing 12 has an insertion opening 46 extending from an end of the first opening 18 in the housing. The insertion opening 46 is in the form of a slot and is arranged with respect to the drum 32 such that the attachment strip 38 can be brought into engagement with the receiving means 40 on the drum by inserting the attachment strip through the insertion opening 46 in a direction substantially parallel to the longitudinal axis 34 of the drum. In this manner, any display sheet which is mounted to an attachment strip 38 can be easily connected to the information presentation device without having to dismantle the device.

In terms of the second embodiment, the first opening 18 in the housing 12 is arranged with respect to the drum 32 such that the longitudinally extending slot 42 in the drum 32 can be positioned adjacent the first opening 18 seen in the radial direction to thereby allow the attachment strip 36 to be inserted into the slot 42 in a direction perpendicular to the longitudinal axis 34 of the drum.

Figure 4:
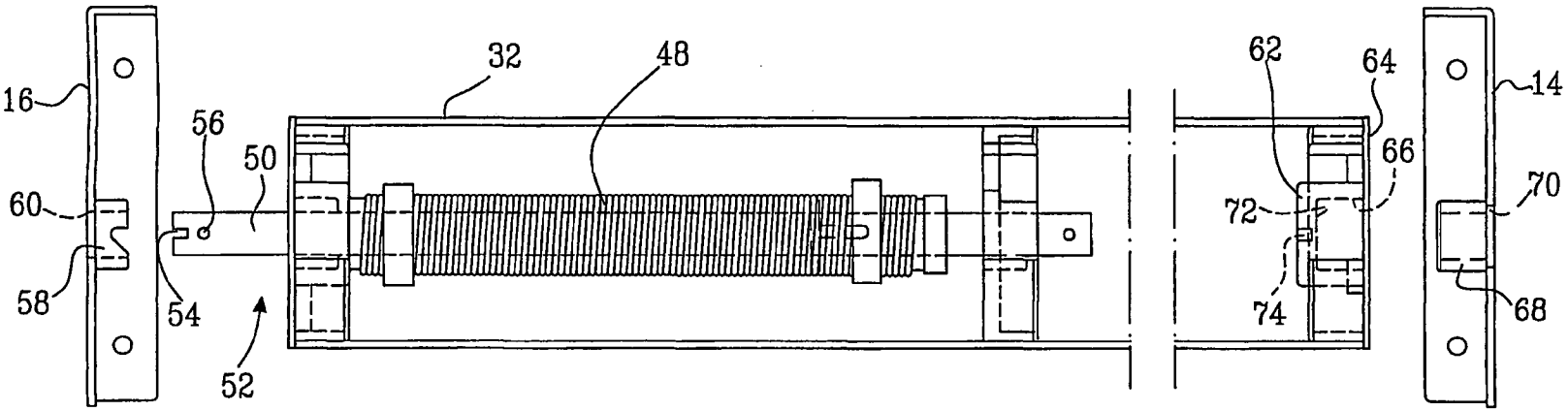
FIG. 4 is a schematic sectional plan view of the drum and end walls of the device according to FIG. 1.

For both embodiments, the drum 32 is preferably spring-biased such that when a display sheet is attached to the drum, the display sheet is drawn into the housing. In a manner known per se, and as is illustrated in FIG. 4, the drum is hollow 32 and accommodates a biasing spring 48 mounted around a spindle 50 of the drum. The spindle is arranged for relative axial displacement with respect to the drum 32 against the action of the biasing spring. In a preferred embodiment of the invention, the spring biasing is adjustable by means of a tensioning device 52 accessible from outside the housing. The tensioning device 52 may comprise a slot 54 in one end of the spindle 50. Adjacent the end of the spindle there is provided a transversely extending engagement pin 56. The engagement pin 56 is arranged to cooperate with a rachet arrangement 58 mounted on the end wall 16 concentrically with the spindle 50. The rachet arrangement 58 has a centrally positioned through bore which is aligned with an opening 60 in the end wall 16. When the engagement pin 56 is in cooperation with the rachet arrangement, the end of the spindle comprising the slot 54 lies immediately adjacent the opening 60 in the end wall. The rachet arrangement 58 prevents the spindle 50 from rotating under the influence of the spring biasing with respect to the drum 32. In order to alter the tension in the biasing spring 48, a bladed instrument may be inserted through the opening 60 in the end wall 16 to engage the slot 54 in the spindle 50. The spindle may then be displaced inwards, i.e. to the right as shown in FIG. 4 to bring the engagement pin 56 out of engagement with the rachet arrangement 58. The spindle may then by rotated with respect to the drum in order to alter the tension in the biasing spring. Once the desired tension is achieved, the bladed instrument may be withdrawn from the slot 54 to allow the engagement pin 56 to reengage the rachet arrangement.

In order to be able to insert or remove an information sheet, it is necessary that the receiving means 40 on the drum 32 be aligned with either the insertion opening 46 in the housing (FIGS. 1 to 4) or the first opening 18 in the housing (FIGS. 5 and 6). To facilitate the alignment operation, in a preferred embodiment of the invention the drum 32 is provided with positioning means 62, the positioning means being accessible from outside the housing. Possible positioning means 62 are illustrated in FIG. 4. It is to be understood that identical positioning means may also be employed in the embodiment illustrated in FIGS. 5 and 6. Thus, the positioning means may comprise an end plate 64 fixedly mounted to the drum 32 and constrained to rotate therewith. The end plate 64 displays an annular recess 66 located concentrically with the longitudinal axis 34 of the drum 32. The annular recess 66 comprises an inner facing surface which acts as a bearing surface for the drum and cooperates with a cylindrical support member 68 affixed to the end wall 14 of the housing. The cylindrical support member 68 is aligned with a positioning opening 70 in the end wall 14. The annular recess 66 further comprises a base section 72 provided with a slot 74. By inserting a bladed instrument through the positioning opening 70 in the end wall 14 so that the instrument engages the slot 74, the angular position of the drum 32 can be adjusted.

In certain circumstances, for example if the information presentation device is delivered with the biasing spring 48 in a pretensioned condition, it is necessary to be able to lock the drum 32 in a position at which the receiving means 40 on the drum 32 is aligned with either the insertion opening 46 or the first opening 18 in the housing. To this effect, the end wall 14 of the housing may be provided with a locking opening 76 through which locking means in the form of e.g. a locking pin 78 may be inserted. The locking pin 78 is intended to engage a (not shown) recess or opening in the end plate 64 on the drum 32. In this manner, the locking means is accessible from outside the housing to effect locking of the drum when a display sheet is e.g. substantially fully unwound from the drum.

In order to ensure stability of the information display device, particularly when the display sheet is erect, the housing 12 may be provided with support means 80, for example in the form of two pairs of outwardly pivotable feet (FIG. 2).

The information display device 10 according to the present invention may be delivered to the consumer either with the biasing spring 48 in a pretensioned or non-tensioned condition. In the following, methods of mounting a display sheet to both embodiment of the device will be described for these two conditions.

For the embodiment illustrated in FIGS. 1 to 4, when the information display device is delivered with the biasing spring in a non-tensioned condition, a display sheet 26 may be mounted to the device by firstly bringing the receiving means 40 on the drum 32 into alignment with the insertion opening 46 in the end wall 14 of the housing. As has been explained above, this can be suitably attained by rotating the drum 32 via the positioning means 62. Thereafter, the attachment strip 38 to which the display sheet 26 is affixed is inserted through the insertion opening 46 in a direction substantially parallel to the longitudinal axis 34 of the drum 32 such that said attachment strip is brought into engagement with the receiving means 40 on the drum. The display sheet is then wound around the drum 32, suitably by means of the positioning means 62. Finally, the biasing spring 48 is tensioned by means of the tensioning device 52 so that the drum tends to retain the display sheet in the housing 12.

When the information display device is delivered with the biasing spring in a tensioned condition, the receiving means 40 on the drum is already predisposed in alignment with the insertion opening 46 in the end wall by means of the locking means 78. A display sheet 26 may be mounted to the device by inserting the attachment strip 38 through the insertion opening 46 in a direction substantially parallel to the longitudinal axis 34 of the drum 32 such that the attachment strip is brought into engagement with the receiving means 40 on the drum. The locking pin78 is then removed such that the display sheet 26 is caused to be wound around the drum as a result of the spring biasing of the drum.

In terms of the embodiment illustrated in FIGS. 5 and 6, when the information display device is delivered with the biasing spring in a non-tensioned condition, a display sheet 26 may be mounted to the device by firstly bringing the receiving means 40 on the drum 32 into alignment with the first opening 18 in the housing 18. As has been explained above, this can be suitably attained by rotating the drum 32 via the positioning means 62. Thereafter, the attachment strip 38 to which the display sheet 26 is affixed is inserted through the first opening 18 in a direction substantially perpendicular to the longitudinal axis 34 of the drum 32 such that said attachment strip is brought into engagement with the receiving means 40 on the drum. The display sheet is then wound around the drum 32, suitably by means of the positioning means 62. Finally, the biasing spring 48 is tensioned by means of the tensioning device 52 so that the drum tends to retain the display sheet in the housing 12.

When the information display device is delivered with the biasing spring in a tensioned condition, the receiving means 40 on the drum is already predisposed in alignment with the first opening 18 in the housing by means of the locking means 78. A display sheet 26 may be mounted to the device by inserting the attachment strip 38 through the first opening 18 in a direction substantially perpendicular to the longitudinal axis 34 of the drum 32 such that the attachment strip is brought into engagement with the receiving means 40 on the drum. The locking pin78 is then removed such that the display sheet 26 is caused to be wound around the drum as a result of the spring biasing of the drum.

As is best shown in FIG. 2, the display sheet 26 is preferably provided with an upper support strip 80. When the display sheet is wound on the drum 32, the upper support strip 80 lies over the first opening 18 in the upwardly facing wall 20 of the housing. To facilitate raising of the display sheet, the upwardly facing wall 20 of the housing may be provided with a recess 82 adjacent the first opening 18. In this manner, a user may more easily grasp the upper support strip 80 by inserting his/her fingers into the recess 82. To erect the display sheet, the support rod 24 is assembled and inserted into the second opening 22 in the upwardly facing wall of the housing. The upper support strip 80 is grasped and drawn upwardly, thereby causing the drum 32 to rotate against the action of the biasing spring. The upper support strip is hooked over the remote end of the support rod to thereby maintain the display sheet in an erect condition.

To collapse the display sheet 26, the upper support strip 80 is lifted from the support rod 24 and, under the action of the spring biasing, the drum 32 rotates to draw the display sheet into the housing.

It is to be understood that the invention has been described above by way of example only and that various modifications and alternative embodiments within the scope of the appended claims will be apparent to the skilled person. For example, the support rod 24 may be integrated with the housing 12.

The invention claimed is:

1. An information presentation device for erecting a display sheet from a housing comprising:

an elongate housing having two opposed end walls and a first opening extending longitudinally between said end walls;

a drum having an outer surface, said drum extending about a longitudinal axis and mounted for rotation in said housing between said end walls such that said longitudinal axis is substantially parallel to said first opening in said housing; and attachment means for attaching said display sheet to said drum such that said display sheet can be wound around said drum, said attachment means comprising:

an attachment strip for attachment to one end of said display sheet, and receiving means on said drum for releasably engaging said attachment strip;

said attachment strip and said receiving means forming a releasable mechanical connection;

said drum is provided with a biasing spring such that when said display sheet is attached to said drum, said display sheet can be drawn into said housing under an action of the biasing spring;

wherein said attachment means is configured such that said releasable mechanical connection forms abutment surfaces between the attachment strip and the drum forming a positive stop, said mechanical connection being releasable while said drum remains mounted for rotation between said end walls within said elongate housing, wherein at least one of said end walls of said housing has an insertion opening extending from an end of said first opening, said insertion opening being arranged with respect to said drum such that said attachment strip can be brought into engagement with said receiving means on said drum by inserting said attachment strip through said insertion opening in a direction substantially parallel to said longitudinal axis.

2. The information presentation device as claimed in claim 1, wherein the releasable mechanical connection is a male/female joint in which said attachment strip comprises the male component of the joint.

3. The information presentation device as claimed in claim 2, wherein said receiving means on said drum is a longitudinally extending slot.

4. The information presentation device as claimed in claim 3, wherein said outer surface of said drum comprises a recessed arcuate portion at least partially delimiting one edge of said longitudinally extending slot in said drum, and in that said attachment strip has an arcuate portion which, when said attachment strip is engaged in said longitudinally extending slot, overlies said recessed arcuate portion.

5. The information presentation device as claimed in claim 4, wherein said attachment strip comprises a longitudinally extending shoulder, said shoulder being adapted to abut said one edge of said longitudinally extending slot in said drum when said display sheet is erected.

6. The information presentation device as claimed in claim 1, wherein said drum is spring-biased such that when a display sheet is attached to said drum, said display sheet is drawn into said housing, said spring biasing being adjustable by means of a tensioning device accessible from outside the housing.

7. The information presentation device as claimed in claim 1, wherein said drum is provided with positioning means, said positioning means being accessible from outside the housing to effect alignment of the receiving means on said drum with either said first opening or said insertion opening.

8. The information presentation device as claimed in claim 1, wherein said drum is provided with locking means accessible from outside the housing to effect locking of the drum when a display sheet is substantially fully unwound from said drum.

9. A method of mounting a display sheet to an information presentation device, said device comprising:

an elongate housing having two opposed end walls and a first opening extending longitudinally between said end walls;

a spring-biased drum extending about a longitudinal axis and mounted for rotation in said housing between said end walls such that said longitudinal axis is substantially parallel to said first opening in said housing;

attachment means for attaching a display sheet to said drum such that said display sheet can be wound around said drum, said attachment means comprising:

an attachment strip attached to one end of said display sheet, and receiving means on said drum for releasably engaging said attachment strip;

said method comprising the steps of:

bringing said receiving means on said drum into alignment with an insertion opening in one of said end walls of said housing;

inserting said attachment strip through said insertion opening in a direction substantially parallel to said longitudinal axis such that said attachment strip is brought into engagement with said receiving means on said drum;

winding said display sheet around said drum, and tensioning said spring-biased drum such that said drum tends to retain said display sheet in said housing.

10. A method of mounting a display sheet to an information presentation device, said device comprising:

an elongate housing having two opposed end walls and a first opening extending longitudinally between said end walls;

a pretensioned spring-biased drum extending about a longitudinal axis and mounted for rotation in said housing between said end walls such that said longitudinal axis is substantially parallel to said first opening in said housing;

attachment means for attaching a display sheet to said drum such that said display sheet can be wound around said drum, said attachment means comprising:

an attachment strip attached to one end of said display sheet, and receiving means on said drum for reliably engaging said attachment strip; and locking means for locking said pretensioned spring-biased drum such that said receiving means on said drum is aligned with an insertion opening in an end wall of said housing;

said method comprising the steps of:

inserting said attachment strip through said insertion opening in a direction substantially parallel to said longitudinal axis such that said attachment strip is brought into engagement with said receiving means on said drum; and releasing said locking means such that said display sheet is caused to be wound around said drum.

11. An information presentation device comprising:

an elongate housing having two opposed end walls and a first opening extending longitudinally between said end walls;

a drum having an outer surface, said drum extending about a longitudinal axis and mounted for rotation in said housing between said end walls such that said longitudinal axis is substantially parallel to said first opening in said housing; and attachment means for attaching a display sheet to said drum such that said display sheet can be wound around said drum, said attachment means comprising:

an attachment strip for attachment to one end of said display sheet, and receiving means on said drum for releasably engaging said attachment strip;

said attachment strip and said receiving means forming a releasable mechanical connection;

wherein said attachment means is configured such that said releasable mechanical connection is releasable while said drum is within said elongate housing; and wherein at least one of said end walls of said housing has an insertion opening extending from an end of said first opening, said insertion opening being arranged with respect to said drum such that said attachment strip can be brought into engagement with said receiving means on said drum by inserting said attachment strip through said insertion opening in a direction substantially parallel to said longitudinal axis.

12. An information presentation device comprising:

an elongate housing having two opposed end walls and a first opening extending longitudinally between said end walls;

a drum having an outer surface, said drum extending about a longitudinal axis and mounted for rotation in said housing between said end walls such that said longitudinal axis is substantially parallel to said first opening in said housing; and attachment means for attaching a display sheet to said drum such that said display sheet can be wound around said drum, said attachment means comprising:

an attachment strip for attachment to one end of said display sheet, and receiving means on said drum for releasably engaging said attachment strip, said receiving means on said drum is a longitudinally extending slot, wherein said outer surface of said drum comprises a recessed arcuate portion at least partially delimiting one edge of said longitudinally extending slot in said drum, and in that said attachment strip has an arcuate portion which, when said attachment strip is engaged in said longitudinally extending slot, overlies said recessed arcuate portion;

said attachment strip and said receiving means forming a releasable mechanical connection;

wherein said attachment means is configured such that said releasable mechanical connection is releasable while said drum is within said elongate housing.

13. The information presentation device as claimed in claim 12, wherein said attachment strip comprises a longitudinally extending shoulder, said shoulder being adapted to abut said one edge of said longitudinally extending slot in said drum when said display sheet is erected.

* * * * *